US011231163B2

(12) United States Patent
Patil et al.

(10) Patent No.: US 11,231,163 B2
(45) Date of Patent: Jan. 25, 2022

(54) ARRANGEMENT OF MULTIPLE OPTICAL ELEMENTS TO GENERATE MULTIPLE BEAM PATTERNS

(71) Applicant: APPLETON GRP LLC, Rosemont, IL (US)

(72) Inventors: Sumit Patil, Pune (IN); Sudha Gupta, Orai (IN); Bharat Chaturvedi, Orai (IN)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 17/117,374

(22) Filed: Dec. 10, 2020

(65) Prior Publication Data

US 2021/0172584 A1 Jun. 10, 2021

(51) Int. Cl.

| | |
|---|---|
| ***F21V 14/02*** | (2006.01) |
| ***F21V 7/00*** | (2006.01) |
| ***F21V 5/00*** | (2018.01) |
| ***F21V 19/02*** | (2006.01) |
| ***F21V 7/10*** | (2006.01) |
| ***F21V 7/05*** | (2006.01) |
| *F21V 21/30* | (2006.01) |
| *F21Y 115/10* | (2016.01) |

(52) U.S. Cl.

CPC ..... *F21V 14/02* (2013.01); *F21V 5/007* (2013.01); *F21V 7/05* (2013.01); *F21V 7/10* (2013.01); *F21V 19/02* (2013.01); *F21V 21/30* (2013.01); *F21Y 2115/10* (2016.08)

(58) Field of Classification Search

CPC . F21V 14/02; F21V 7/05; F21V 19/02; F21V 5/007

See application file for complete search history.

(56) References Cited

U.S. PATENT DOCUMENTS

| | | | | |
|---|---|---|---|---|
| 8,657,464 | B2 | 2/2014 | Lundberg et al. | |
| 10,012,361 | B2 | 7/2018 | Stavely et al. | |
| 2008/0273324 | A1* | 11/2008 | Becker | F21V 5/007 362/237 |
| 2013/0265760 | A1 | 10/2013 | Demuynck et al. | |
| 2014/0313717 | A1* | 10/2014 | Miskin | F21V 14/06 362/236 |

OTHER PUBLICATIONS

Combined PCT International Search Report and Written Opinion, Application No. PCT/IB2020/062388, dated May 25, 2021, 11 pages.

* cited by examiner

*Primary Examiner* — Karabi Guharay

(74) *Attorney, Agent, or Firm* — McDonnell Boehnen Hulbert & Berghoff LLP

(57) ABSTRACT

The present disclosure relates to field of an arrangement of multiple optical elements to generate multiple beam patterns. The arrangement (100) of multiple optical elements to plurality of fasteners (112), and an optics plate (106). The array board (102) having LEDs (104) mounted thereon in a plurality of first blade patterns (124*a*-124*d*). The optics plate (106) is removably fastened to the array board. The optics plate (106) defines lenses (108) in a plurality of second blade patterns (126*a*-126*d*) and reflectors (110) in a plurality of third blade patterns (128*a*-128*d*), identical to the first blade pattern (124*a*-124*d*). The optics plate (106) is manually rotated into a first configuration to align the second blade pattern (126*a*-126*d*) with the first blade pattern (124*a*-124*d*) and into a second configuration to align the third blade pattern (128*a*-128*d*) with the first blade pattern (124*a*-124*d*) to generate multiple beam patterns.

2 Claims, 10 Drawing Sheets

ARRANGEMENT OF MULTIPLE OPTICAL ELEMENTS TO GENERATE MULTIPLE BEAM PATTERNS

RELATED APPLICATIONS

This application claims priority to Indian Patent Application No. 201921050884 entitled "AN ARRANGEMENT OF MULTIPLE OPTICAL ELEMENTS TO GENERATE MULTIPLE BEAM PATTERNS" filed on Dec. 10, 2019, the contents of which are herein incorporated by reference in their entirety.

FIELD

The present disclosure relates to the field of an arrangement of multiple optical elements to generate multiple beam patterns.

BACKGROUND

The background information herein below relates to the present disclosure but is not necessarily prior art.

Typically, for generating multiple beam patterns, a secondary optics plate or a reflector plate is mounted on top of the array board. The secondary optics plate has a plurality of sets of lenses configured thereon, the reflector plate has a plurality of sets of reflectors configured thereon and the array board has a plurality of sets of LEDs configured thereon. The multiple symmetric beam pattern is generated either by the light passing through the sets of lenses or by the sets of reflectors. However, to get a desired multiple beam pattern, every time a user needs to mount either the secondary optics plate or the reflector plate at the desired position on the array board of a lighting fixture. This becomes time-consuming and also increases inventory and the storage cost, which is not desired.

There is, therefore, felt a need of an arrangement of multiple optical elements to generate multiple beam patterns which solves the problems as described hereinabove.

Objects

The background information herein below relates to the present disclosure but is not necessarily prior art.

An object of the present disclosure is to provide an arrangement of multiple optical elements to generate multiple beam patterns.

Another object of the present disclosure is to provide the arrangement that reduces the inventory cost and material.

Yet another object of the present disclosure is to provide the arrangement that provides easy late customization at the manufacturing/field location and adds to customer ease.

Still another object of the present disclosure is to provide the arrangement that generates multiple beam patterns.

Another object of the present disclosure is to provide the arrangement that generates desired beam patterns.

Other objects and advantages of the present disclosure will be more apparent from the following description, which is not intended to limit the scope of the present disclosure.

SUMMARY

The present disclosure envisages an arrangement of multiple optical elements to generate multiple beam patterns. The arrangement comprises an array board and an optics plate.

The array board has a plurality of sets of LEDs mounted thereon in a plurality of first blade patterns.

The optics plate is configured to be removably fastened to the array board. The optics plate defines a set of lenses configured thereon in a plurality of second blade patterns and a set of reflectors configured thereon in a plurality of third blade patterns. Each of the second blade patterns and each of the third blade patterns being similar to each of the first blade patterns. The optics plate is configured to be manually rotated into a first configuration to align the second blade pattern with the first blade pattern and into a second configuration to align the third blade pattern with the first blade pattern to generate multiple beam patterns.

In an embodiment, the optics plate is removably fastened to the array board via a plurality of fasteners.

In another embodiment, each of the second blade patterns has an angular offset with each of the third blade patterns.

In an embodiment, each of the second blade patterns is disposed at a pre-determined angle to an adjacent second blade pattern.

In another embodiment, each of the third blade patterns is disposed at a pre-determined angle to an adjacent third blade pattern.

In an embodiment, the lenses in each of the second blade patterns are radially aligned on the optics plate.

In another embodiment, the reflectors in each of the third blade patterns are radially aligned on the optics plate.

In an embodiment, the array board and the optics plate are configured in a form of a circular disk and the sets of lenses, LEDs and reflectors are in the form of rays operatively radially disposed on the circular disk.

Each of the first blade patterns, each of the second blade patterns and each of the third blade patterns, are constituted by a linear arrangement of the lenses, LEDs and reflectors and a twisted arrangement of lenses, LEDs and reflectors, wherein the twisted arrangement constitutes a first subset of lenses, LEDs and reflectors and a second subset of lenses, LEDs and reflectors.

In another embodiment, the first subset and the second subset are in a linear arrangement, and the first subset is offset from the second subset to form a twist. The first subset and the second subset are radially disposed with respect to the centre of the disk.

BRIEF DESCRIPTION OF THE ACCOMPANYING DRAWING

An arrangement of multiple optical elements to generate multiple beam patterns of the present disclosure will now be described with the help of the accompanying drawing, in which:

FIG. 1*a* illustrates a top view of an arrangement of multiple optical elements to generate multiple beam patterns;

FIG. 1*b* illustrates a top view of the arrangement of sets of lenses and sets of reflectors on an optics plate;

Figure 4A:
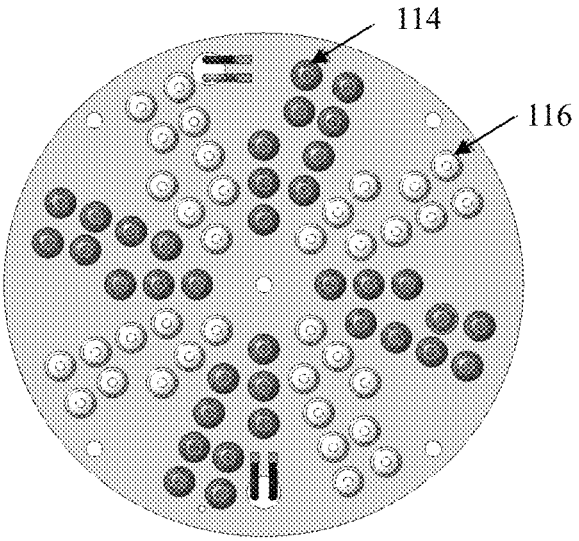
Figure 4B:
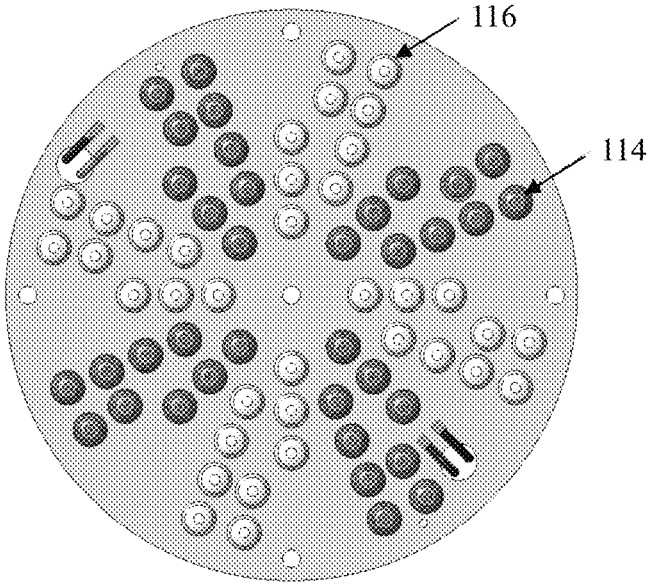
Figure 5A:
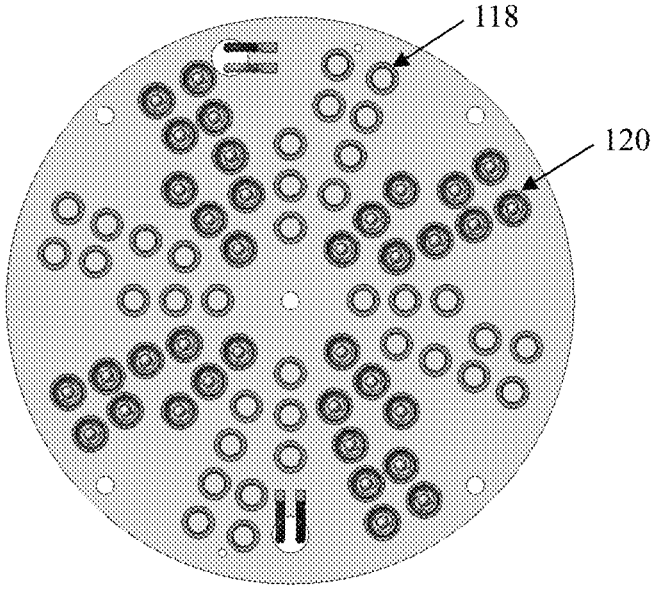
Figure 5B:
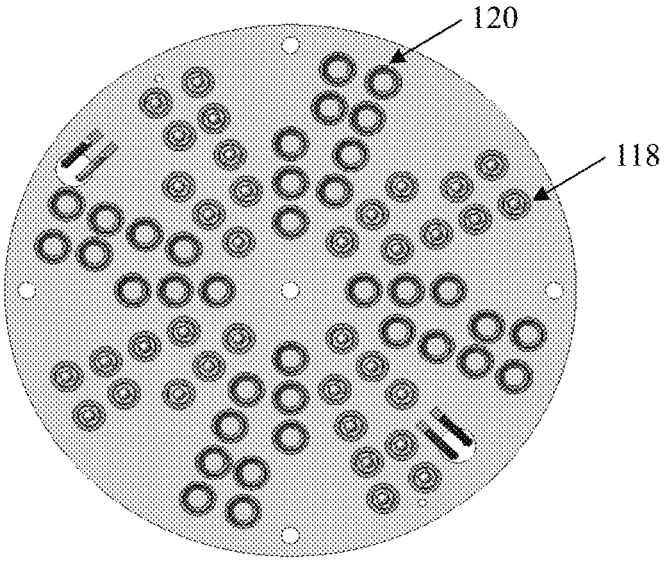
Figure 6:
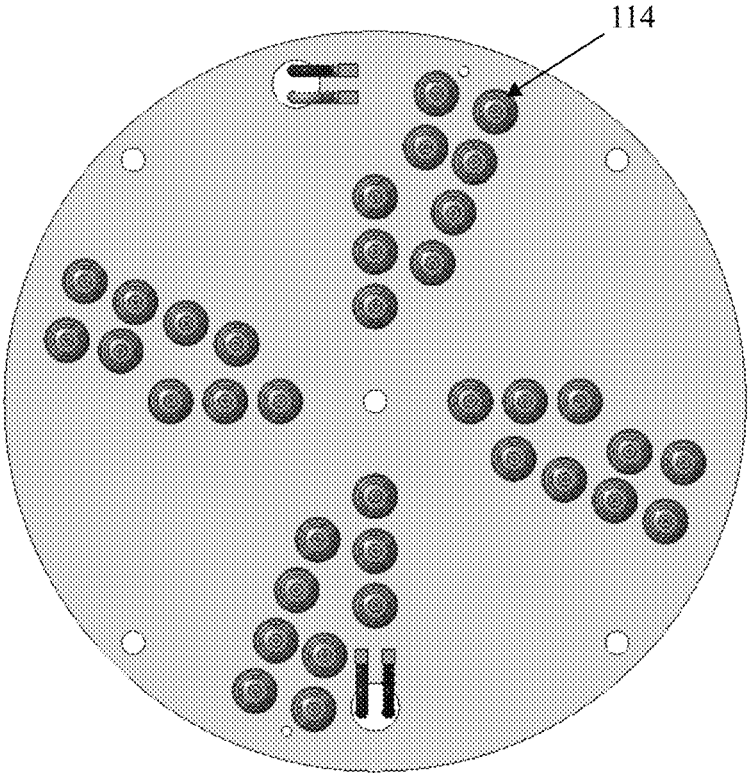
Figure 7:
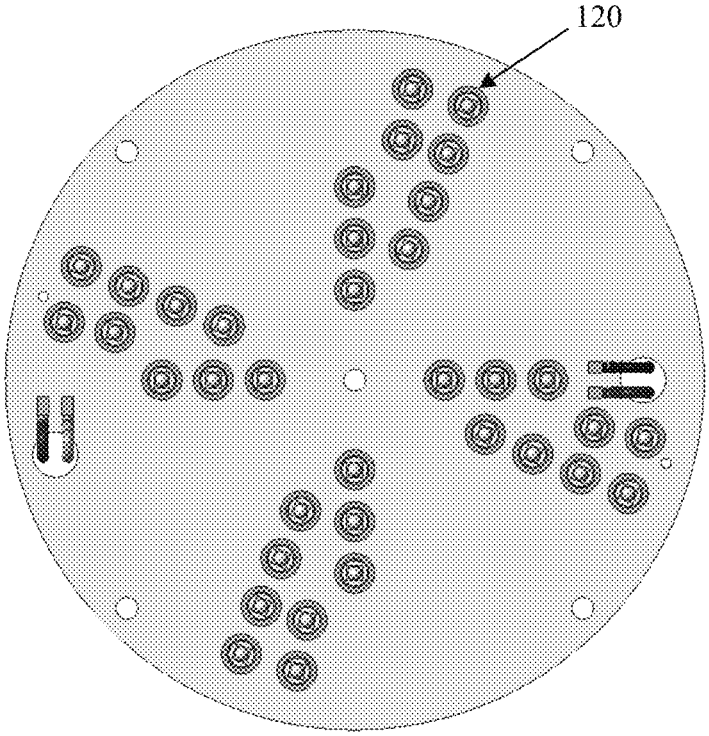

FIGS. 4*a* and 4*b* illustrate a top view of two different sets of lenses arranged on one plate, in accordance with an embodiment of the present disclosure;

FIGS. 5*a* and 5*b* illustrate a top view of two different sets of reflectors arranged on one plate, in accordance with another embodiment of the present disclosure;

FIG. 6 illustrates a top view of only one set of lens arranged on the plate in a blade pattern, in accordance with yet another embodiment of the present disclosure; and FIG. 7 illustrates a top view of only one set of reflectors arranged on the plate in a blade pattern, in accordance with still another embodiment of the present disclosure.

| LIST OF REFERENCE NUMERALS | |
|---|---|
| 100 | Arrangement |
| 102 | array board |
| 104 | LEDs |
| 106 | optics plate |
| 108 | Lenses |
| 110 | Reflectors |
| 112 | Fasteners |
| 114 | 7X7 lenses |
| 116 | 6X6 lenses |
| 118 | 7X7 reflectors |
| 120 | 6X6 reflectors |
| 122 | lighting fixture |
| 124a-d | Blade pattern of LEDs |
| 126a-d | Blade pattern of lenses |
| 128a-d | Blade pattern of reflectors |
| 130 | First subset |
| 132 | Second subset |

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details, are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, elements, modules, units and/or components, but do not forbid the presence or addition of one or more other features, elements, components, and/or groups thereof.

An arrangement of multiple optical elements to generate multiple beam patterns of the present disclosure, is described with reference to FIG. 1*a* through FIG. 7.

Figure 1A:
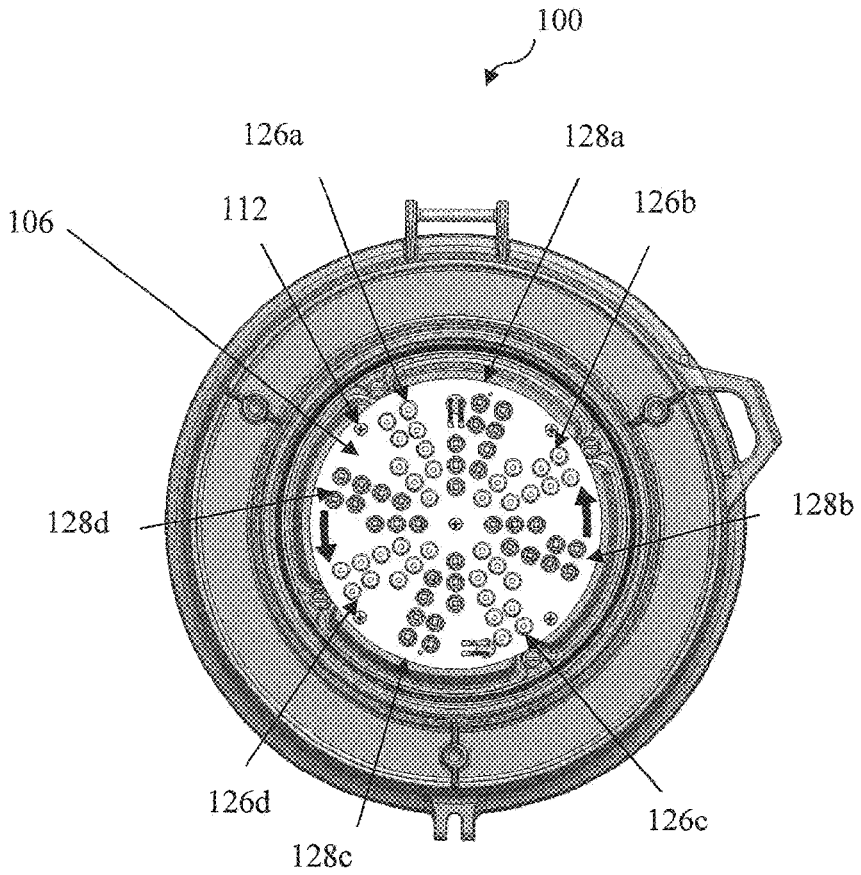
Figure 1B:
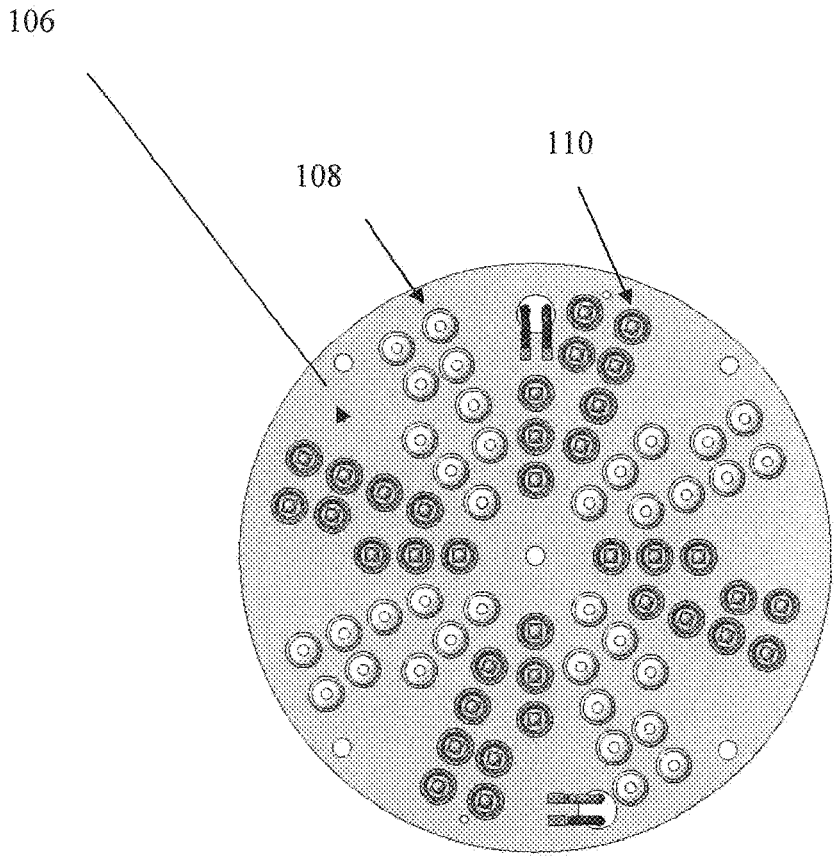

Referring to FIGS. 1*a* and 1*b*, the arrangement of multiple optical elements to generate multiple beam patterns (hereinafter referred as "arrangement") (100) comprises an array board (102) and an optics plate (106).

The array board (102) is having a plurality of sets of LEDs (104) mounted thereon in a plurality of first blade patterns (124*a*-124*d*).

The optics plate (106) is configured to be removably fastened to the array board (102). The optics plate (106) defines a set of lenses (108) configured thereon in a plurality of second blade patterns (126*a*-126*d*) and a set of reflectors (110) configured thereon in a plurality of third blade patterns (128*a*-128*d*). Each of the second blade patterns (126*a*-126*d*) and each of the third blade patterns (128*a*-128*d*) being similar to each of the first blade patterns (124*a*-124*d*). The optics plate (106) is configured to be manually rotated into a first configuration to align the second blade patterns (126*a*-126*d*) with the first blade patterns (124*a*-124*d*) and into a second configuration to align the third blade patterns (128*a*-128*d*) with the first blade patterns (124*a*-124*d*) to generate multiple beam patterns.

In an embodiment, the optics plate (106) is removably fastened to the array board via a plurality of fasteners (112).

In another embodiment, each of the second blade patterns (126*a*-126*d*) has an angular offset with each of the third blade patterns (128*a*-128*d*).

In an embodiment, each of the second blade patterns (126*a*-126*d*) is disposed at a pre-determined angle to an adjacent second blade pattern (126*a*-126*d*).

In another embodiment, each of the third blade patterns (128*a*-128*d*) is disposed at a pre-determined angle to an adjacent third blade pattern (128*a*-128*d*).

In an embodiment, the lenses (108) in each of the second blade patterns (126*a*-126*d*) are radially aligned on the optics plate (106).

In another embodiment, the reflectors (110) in each of the third blade patterns (128*a*-128*d*) are radially aligned on the optics plate (106).

In an embodiment, the array board (102) and the optics plate (106) are configured in a form of a circular disk and the set of lenses (108), LEDs (104) and reflectors (110) are in the form of rays operatively radially disposed on the circular disk.

Figure 2:
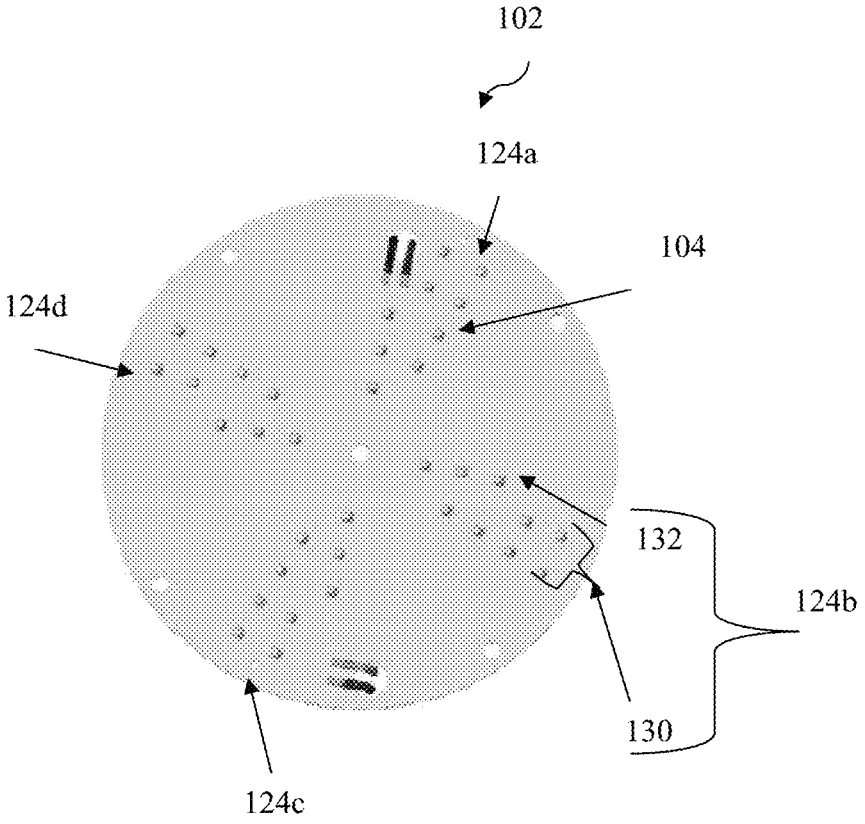
FIG. 2 illustrates a top view of an array board having LEDs mounted thereon in a blade pattern.

Referring to FIG. 2, each of the first blade patterns (124*a*-124*d*), each of the second blade patterns (126*a*-126*d*) and each of the third blade patterns (128*a*-128*d*), are constituted by a linear arrangement of the lenses (108), LEDs (104) and reflectors (110) and a twisted arrangement of lenses (108), LEDs (104) and reflectors (110), wherein the twisted arrangement constitutes a first subset (130) of lenses (108), LEDs (104) and reflectors (110) and a second subset (132) of lenses (108), LEDs (104) and reflectors (110).

In another embodiment, the first subset (130) and the second subset (132) are in a linear arrangement, and the first subset (130) is offset from the second subset (132) to form a twist. The first subset (130) and the second subset (132) are radially disposed with respect to the centre of the disk.

Figure 3:
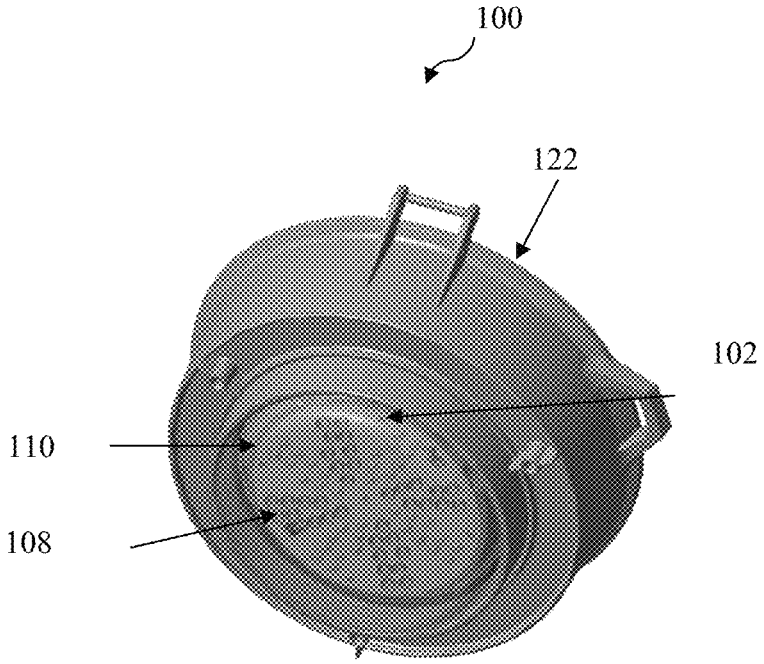
FIG. 3 illustrates an isometric view of the arrangement of multiple optical elements of FIG. 1 fixed on a lighting fixture.

FIG. 3 illustrates an isometric view of the arrangement (100) of multiple optical elements of FIG. 1 fixed on the lighting fixture (122).

In an embodiment, the experimental results show that, in the first configuration, the conventional arrangement generates E_av (average illuminance) of 13 fc (foot candles) and has a uniformity of 0.578 whereas in the first configuration, the arrangement of the present disclosure generates E av of 13 fc and has a uniformity of 0.709. The arrangement of the present disclosure shows that the uniformity is better as compared to the conventional arrangement.

In another embodiment, the experimental results show that, in the second configuration, the conventional arrangement generates E av of 21 fc and has a uniformity of 0.327 whereas in the second configuration, the arrangement of the present disclosure generates E av of 22 fc and has a uniformity of 0.225. The average foot candela is better in the arrangement of the present disclosure with no dark spot ring observed, as compared to the conventional arrangement.

FIGS. 4*a* and 4*b* illustrate a top view of two different set of lenses, i.e., a 6×6 set of lenses (116) and a 7×7 set of lenses (114), arranged on one plate in a blade pattern, in accordance with an embodiment of the present disclosure. When the plate is aligned at 0°, the set of 7×7 lenses (114) get aligned with the plurality of LEDs (104) and generate beam patterns, and the set of 6×6 lenses (116) are inactive as they are not aligned with the plurality of LEDs (104). The average illuminance generated by the 7×7 set of lenses (114) is 16 fc and the uniformity achieved is 0.440.

When the plate is aligned at 45°, the set of 6×6 lenses (116) get aligned with the plurality of LEDs (104) and generate beam patterns, and the set of 7×7 lenses (114) are inactive as they are not aligned with the plurality of LEDs (104). The average illuminance generated the 6×6 set of lenses (116) is 20 fc and the uniformity achieved is 0.147.

FIGS. 5*a* and 5*b* illustrate a top view of two different set of reflectors, i.e., a 6×6 set of lenses (116) and a 7×7 set of lenses (114), arranged on one plate in a blade pattern, in accordance with another embodiment of the present disclosure. When the plate is aligned at 0°, the set of 6×6 reflectors (120) get aligned with the plurality of LEDs (104) and generate beam patterns, and the set of 7×7 reflectors (118) are inactive as they are not aligned with the plurality of LEDs (104). The average illuminance generated by the set of 6×6 reflectors (120) is 21 fc and the uniformity achieved is 0.107.

When the plate is aligned at 45°, the set of 7×7 reflectors (118) get aligned with the plurality of LEDs (104) and generate beam patterns, and the set of 6×6 reflectors (120) are inactive as they are not aligned with the plurality of LEDs (104). The average illuminance generated by the set of 7×7 reflectors (118) is 19 fc and the uniformity achieved is 0.256.

FIG. 6 illustrates a top view of only one set of lenses arranged on the plate in a blade pattern, in accordance with yet another embodiment of the present disclosure. The set of 7×7 lenses (114) when aligned with the plurality of LEDs (104) generate an average illuminance of 16 fc and uniformity achieved is 0.440.

FIG. 7 illustrates a top view of only one set of reflectors arranged on the plate in a blade pattern, in accordance with still another embodiment of the present disclosure. The set of 6×6 reflectors (120) when aligned with the plurality of LEDs (104) generate an average illuminance of 21 fc and uniformity achieved is 0.107.

In an embodiment, the variation in distance between the LEDs facilitates the generation of the desired beam pattern.

The present arrangement (100) facilitates generation of multiple beam patterns by manual rotation of the optics plate (106) as compared to the conventional arrangements. Further, there is a reduction in the inventory cost and the material by using a single optics plate (106) in contrary to the conventional arrangements that comprises of a separate optics plate and a separate reflector plate.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

Technical Advancements

The present disclosure described herein above has several technical advantages including, but not limited to, the realization of, an arrangement of multiple optical elements to generate multiple beam patterns, which:

reduces the inventory cost and material;

generates multiple beam patterns;

generates desired beam patterns; and facilitates easy late factory/field customization.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, or group of elements, but not the exclusion of any other element, or group of elements.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. An arrangement (100) of multiple optical elements to generate multiple beam patterns, said arrangement (100) comprising:

an array board (102) having a plurality of sets of LEDs (104) mounted thereon in a plurality of first blade patterns (124*a*-124*d*); and an optics plate (106) configured to be removably fastened to said array board (102), said optics plate (106) defining a set of lenses (108) configured thereon in a plurality of second blade patterns (126*a*-126*d*) and a set of reflectors (110) configured thereon in a plurality of third blade patterns (128*a*-128*d*), each of said second blade patterns (126*a*-126*d*) and each of said third blade patterns (128*a*-128*d*) being similar to each of said first blade patterns (124*a*-124*d*), said optics plate (106) configured to be manually rotated into a first configuration to align said second blade pattern (126*a*-126*d*) with said first blade pattern (124*a*-124*d*) and into a second configuration to align said third blade pattern (128*a*-128*d*) with said first blade pattern (124*a*-124*d*) to generate multiple beam patterns; wherein each of said first blade patterns (124*a*-124*d*), each of said second blade patterns (126*a*-126*d*) and each of said third blade patterns (128*a*-128*d*) are constituted by a linear arrangement of said lenses (108), LEDs (104) and reflectors (110) and a twisted arrangement of lenses (108), LEDs (104) and reflectors (110), wherein said twisted arrangement constitutes a first subset (130) of a plurality of lenses (108), LEDs (104) and a plurality of reflectors (110) and a second subset (132) of a plurality of lenses (108), LEDs (104) and a plurality of reflectors (110).

2. The arrangement (100) as claimed in claim 1, wherein said first subset (130) and said second subset (132) are in a linear arrangement, and said first subset (130) is offset from said second subset (132) to form a twist, said first subset (130) and said second subset (132) are radially disposed with respect to the centre of the disk.

* * * * *